US005990611A

United States Patent [19]

Lee

[11] Patent Number: 5,990,611

[45] Date of Patent: Nov. 23, 1999

[54] LIGHT BULB TYPE FLUORESCENT LAMP SUPPRESSING ELECTROMAGNETIC WAVES AND EMITTING FAR INFRARED RAYS

[75] Inventor: Jae Ryong Lee, Inchon-shi, Rep. of Korea

[73] Assignee: Shin Kwang Enterprise Co., Ltd., Choongchung Nam-Do, Rep. of Korea

[21] Appl. No.: 08/947,020

[22] Filed: Oct. 8, 1997

[30] Foreign Application Priority Data

Oct. 9, 1996 [KR] Rep. of Korea ..... 96-33248

[51] Int. Cl.[6] ..... H01J 1/62; H01J 63/04; H01J 17/16; H01J 61/30

[52] U.S. Cl. ..... 313/493; 313/110; 313/634; 313/635

[58] Field of Search ..... 313/493, 573, 313/634, 635, 110, 112, 113, 318.6, 318.7, 242, 315, 578.79; 362/293, 260; 250/504 R, 493.1; 359/350

[56] References Cited

U.S. PATENT DOCUMENTS 5,571,460 11/1996 Choi et al. ..... 252/587
5,744,899 4/1998 Lee et al. ..... 313/110

*Primary Examiner*—Nimeshkumar D. Patel
*Assistant Examiner*—Mack Haynes
*Attorney, Agent, or Firm*—Finnegan, Henderson, Farabow, Garrett & Dunner, L.L.P.

[57] ABSTRACT

A light bulb type fluorescent lamp which is able to suppress generation of electromagnetic waves and to emit beneficial far infrared rays. The light bulb type fluorescent lamp includes a bioceramic material applied to the inner surfaces of an injection housing which contains a stabilizer and other parts. The bioceramic effectively weakens the strength of the electromagnetic waves generated by the stabilizer to minimize damage to electronic equipment. At the same time, the bioceramic emits far infrared rays which benefit the human body, provide a comfortable living environment and raise the efficiency of the body.

4 Claims, 1 Drawing Sheet

LIGHT BULB TYPE FLUORESCENT LAMP SUPPRESSING ELECTROMAGNETIC WAVES AND EMITTING FAR INFRARED RAYS

BACKGROUND OF THE INVENTION

1. Field of the Invention

The present invention relates to a light bulb type fluorescent lamp, particularly a light bulb type fluorescent lamp which is able to reduce the emission of the electromagnetic waves and radiate far infrared rays.

2. Description of the Prior Art

In homes, offices and composite intelligent buildings, the light bulb type fluorescent lamp has an excellent power-saving effect and has a longer life than the conventional light bulb or the conventional fluorescent lamp. Therefore, the use of the light bulb type fluorescent lamp has been gradually increasing.

In the case of the conventional light bulb type fluorescent lamp, the inside of the injection housing is provided with several parts including a stabilizer to ignite the light bulb type fluorescent lamp. However, generally the stabilizer emits many electromagnetic waves harmful to the human body and various kinds of electronic appliances. Thus, the conventional light bulb type fluorescent lamp produces a lot of electromagnetic waves.

If the strength of the electromagnetic waves is strong or the emission of the electromagnetic waves lasts for a long time, various electronic appliances will be seriously damaged. Malfunctions may occur as a result of damage in the electronic circuits of electronic systems or their control operations. Also, this causes problems in the operation of sequence equipment and so on to cause safety accidents. The strong electromagnetic waves or the long duration of emission of the electromagnetic waves may cause damage to expensive electronic equipment and the human body. These problems will increase in the future by developing this technology and increasing excessive use of the electromagnetic waves.

SUMMARY OF THE INVENTION

This invention has been developed in order to solve the above problems, and the object of this invention is to provide a light bulb type fluorescent lamp which is capable of both weakening the strength of the electromagnetic waves generated in the stabilizer and emitting far infrared rays by applying bioceramics on the inside surface of the injection housing which surrounds the stabilizer radiating the electromagnetic waves. Thus a light bulb type fluorescent lamp according to this invention is able to safeguard the stability of various indoor electronic systems and to provide a healthy and comfortable living environment.

DETAILED DESCRIPTION OF THE EMBODIMENT

Figure 1:
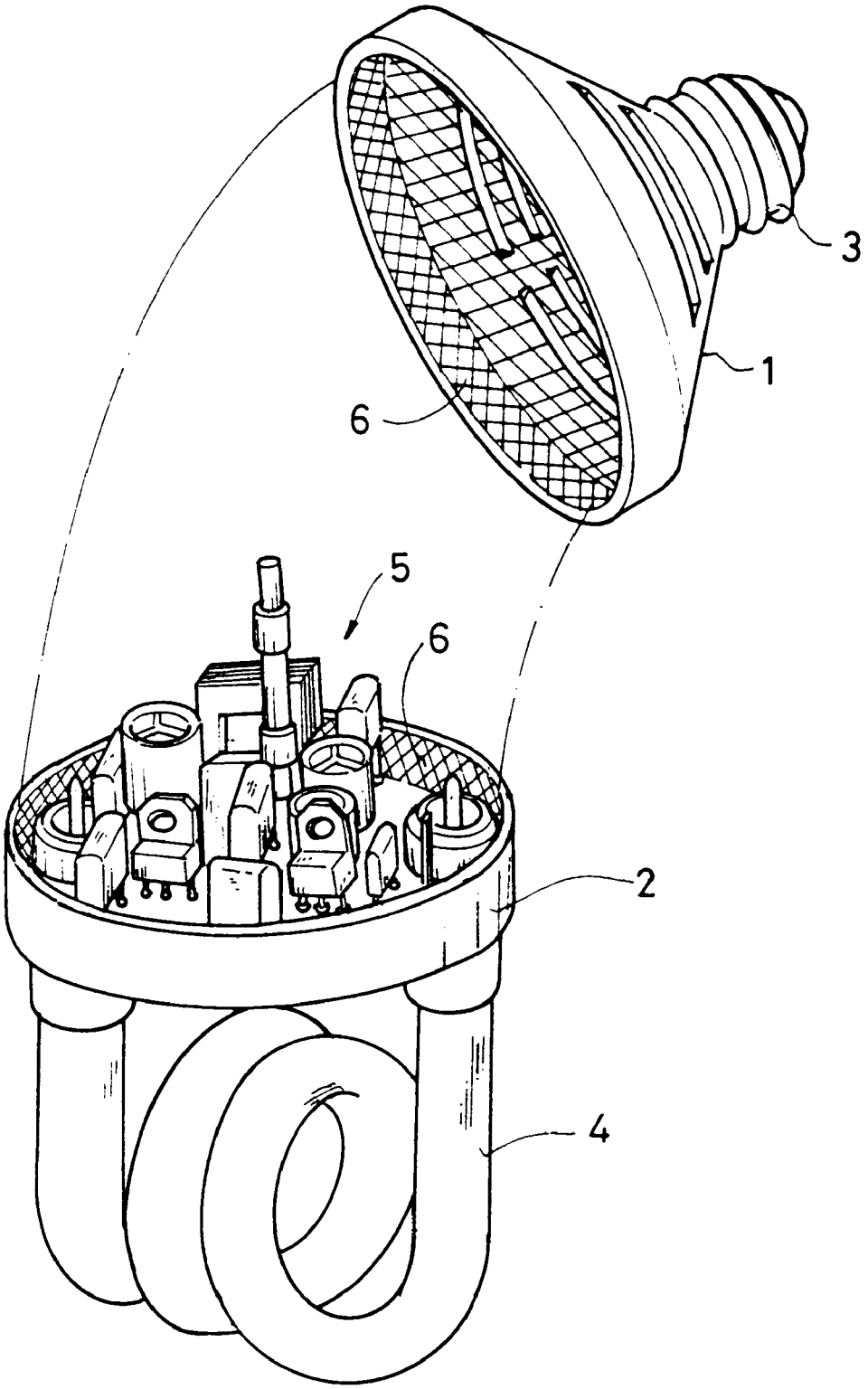
FIG. 1 is a perspective view showing the upper housing and the lower housing which are assembled to the light bulb type fluorescent lamp according to the present invention.

Hereinafter, the light bulb type fluorescent lamp according to this invention to accomplish the above object of this invention will be described with reference to the accompanying drawings.

FIG. 1 is the disassembled perspective view showing the structure of the light bulb type fluorescent lamp according to this invention.

As illustrated in FIG. 1, the light bulb type fluorescent lamp according to this invention is disassembled to an upper housing 1 and a lower housing 2. The upper housing 1 is provided with a socket base 3. The upside of the base plate of the lower housing 2 is provided with a stabilizer 5 and the other parts and the lowerside of the base plate thereof is provided with the fluorescent lamp 4.

As shown in FIG. 1, the bioceramics 6 is applied to each of the inside surfaces of the upper housing 1 and the lower housing 2 of the light bulb type fluorescent lamp according to this invention. Thus, it is able to weaken the strength of the electromagnetic waves generated in the stabilizer and emit far infrared rays which are beneficial to the human body.

The light bulb type fluorescent lamp according to this invention is covered with bioceramics 6 on each of the inside surfaces of the upper housing 1 and the lower housing 2 surrounding the stabilizer 5 and the other parts. Therefore, the strength of the electromagnetic waves generated in the stabilizing apparatus 5 is reduced by 50 percent or more in comparison with that of conventional light bulb type fluorescent lamps. Thus, the light bulb type fluorescent lamp according to this invention is capable of operating without causing problems to various indoor electronic equipment. It is also capable of emitting far infrared rays which are beneficial to the human body from the bioceramics 6. This provides a comfortable living environment and improves the efficiency of the human body.

As described above, in the light bulb type fluorescent lamp according to the present invention, in order to suppress the emission to the outside of the electromagnetic waves generated from the stabilizer 5, the bioceramics 6 is applied to the inside surfaces of the injection housings 1 and 2. Bioceramics 6 is capable of reducing the strength of the electromagnetic waves generated in the stabilizer 5, thus preventing the malfunction of electronic circuits and the limitations of control operations in various electronic circuits for communication and so on in the composite intelligent buildings owing to the electromagnetic waves. As a result, it is possible to prevent damage to electronic systems and the malfunction of the sequence equipment and so on. Thus safety accidents can be prevented. Also, far infrared rays beneficial to the human body which are radiated from the bioceramics are able to provide a healthy and comfortable living environment.

The term "intelligent building" is used to describe a building which comprises various kinds of information-communicating equipment systems and has a high quality information-communicating function, so that in the intelligent building it is possible to obtain the latest information cheaply. And, an intelligent building also means the building is provided with a central computer which is able to automatically control the temperature, the humidity, the illuminance of the light and so on in the building. Thus, an "intelligent building" is an advanced building which is capable of providing an optimal indoor circumstance by using only a minimum energy.

The term "bioceramic" is used to describe a meterial capable of emitting far infrared radiation. The material is generally formed by first combining 20 or more of metals, clay, Fe203, NA2O, SiO2, or Al203, and second, firing the material at a high temperature of about 1600° C. The bioceramic can radiate far infrared rays, similar to far infrared rays radiated from the sun, having long wavelengths and frequencies invisible to the naked eye.

Therefore, at the high temperature, the productivity and the quality of goods is improved with heating far infrared rays, and at the low temperature, there is the effect that the far infrared rays activate the metabolism of the human body and preserve the freshness of foods. Specially, if far infrared rays are emitted to the human body, the circulation of the blood will be promoted and the fine blood vessels will be widened in the human body, so that the metabolism will be strengthened and the organism ability of the human body will be improved.

What is claimed is:

1. A light bulb type fluorescent lamp, wherein said lamp comprises:

an upper housing portion having walls defining a first inner surface;

a lower housing portion having walls and configured to connectably engage said upper housing portion such that said upper housing portion and said lower housing portion define an internal space, and wherein said walls of said lower housing portion define a second inner surface;

a baseplate including a first side and a second side, said first side of said baseplate adapted to connect with said lower housing portion;

a stabilizer disposed on said first side of said baseplate;

a fluorescent lighting element disposed on said second side of said baseplate; and a far infrared emitting material for emitting beneficial far infrared rays, the far infrared emitting material being disposed on both said first inner surface of said upper housing portion and said second inner surface of said lower housing portion, wherein said far infrared emitting material is a bioceramic.

2. The light bulb type fluorescent lamp of claim 1, wherein said stabilizer emits electromagnetic waves, and said far infrared emitting material reduces the strength of said electromagnetic waves.

3. The light bulb type fluorescent lamp of claim 2, wherein said far infrared emitting material reduces the strength of said electromagnetic waves by at least 50%.

4. The light bulb type fluorescent lamp of claim 1, wherein said upper housing portion includes a socket base for connecting to a source of power.

* * * * *